US008847472B1

(12) United States Patent
Titzler et al.

(10) Patent No.: US 8,847,472 B1
(45) **Date of Patent: *Sep. 30, 2014**

(54) LAMINATE SUPPORT STRUCTURE FOR AN LED IN A LIQUID-FILLED BULB

(71) Applicant: Switch Bulb Company, Inc., San Jose, CA (US)

(72) Inventors: David Titzler, Palo Alto, CA (US); Glenn Wheelock, San Jose, CA (US); Ronan Le Toquin, Fremont, CA (US); David Horn, Saratoga, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/708,897

(22) Filed: Dec. 7, 2012

Related U.S. Application Data

(60) Provisional application No. 61/569,191, filed on Dec. 9, 2011, provisional application No. 61/579,626, filed on Dec. 22, 2011, provisional application No. 61/585,226, filed on Jan. 10, 2012, provisional application No. 61/682,163, filed on Aug. 10, 2012.

(51) Int. Cl.
*H01J 1/02* (2006.01)
*F21V 29/00* (2006.01)

(52) U.S. Cl.
CPC ..... *F21V 29/004* (2013.01)
USPC ..... 313/22; 313/12; 313/35

(58) Field of Classification Search
USPC ..... 313/11, 12, 22, 24, 35; 362/373
See application file for complete search history.

(56) References Cited

U.S. PATENT DOCUMENTS 8,277,094 B2 * 10/2012 Wheelock et al. ..... 362/373
8,562,185 B2 * 10/2013 Wheelock et al. ..... 362/373

* cited by examiner

*Primary Examiner* — Vip Patel
(74) *Attorney, Agent, or Firm* — Morrison & Foerster LLP

(57) ABSTRACT

A method of making a light-emitting diode (LED) bulb and an LED bulb comprising a base, a shell connected to the base forming an enclosed volume. A thermally conductive liquid is held within the enclosed volume. A laminate support structure connected to the base and a plurality of flange portions formed in the laminate support structure. A plurality of LEDs are attached to the plurality of flange portions and arranged in a radial array.

16 Claims, 6 Drawing Sheets

LAMINATE SUPPORT STRUCTURE FOR AN LED IN A LIQUID-FILLED BULB

CROSS REFERENCE TO RELATED APPLICATIONS

This application claims the benefit under 35 U.S.C. 119(e) of prior U.S. Provisional Patent Application No. 61/569,191, filed Dec. 9, 2011, U.S. Provisional Patent Application No. 61/579,626, filed Dec. 22, 2011, U.S. Provisional Patent Application No. 61/585,226, filed Jan. 10, 2012, and U.S. Provisional Patent Application No. 61/682,163, filed Aug. 10, 2012, each of which is hereby incorporated by reference in the present disclosure in its entirety.

BACKGROUND

1. Field

The present disclosure relates generally to light-emitting diode (LED) bulbs, and more specifically to using a laminate structure for mounting LEDS in a liquid-filled LED bulb.

2. Description of Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

While there are many advantages to using an LED bulb rather than an incandescent or fluorescent bulb, LEDs have a number of drawbacks that have prevented them from being as widely adopted as incandescent and fluorescent replacements. One drawback is that an LED, being a semiconductor, generally cannot be allowed to get hotter than approximately 120° C. As an example, A-type LED bulbs have been limited to very low power (i.e., less than approximately 8 W), producing insufficient illumination for incandescent or fluorescent replacements.

One approach to alleviating the heat problem of LED bulbs is to use a thermally conductive liquid to cool the LEDS. To facilitate thermal dissipation, it may be advantageous to increase the thermal paths from the LED to the environment.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various embodiments are described below relating to LED bulbs. As used herein, an "LED bulb" refers to any light-generating device (e.g., a lamp) in which at least one LED is used to generate light. Thus, as used herein, an "LED bulb" does not include a light-generating device in which a filament is used to generate the light, such as a conventional incandescent light bulb. It should be recognized that the LED bulb may have various shapes in addition to the bulb-like A-type shape of a conventional incandescent light bulb. For example, the bulb may have a tubular shape, a globe shape, or the like. The LED bulb of the present disclosure may further include any type of connector; for example, a screw-in base, a dual-prong connector, a standard two- or three-prong wall outlet plug, bayonet base, Edison Screw base, single-pin base, multiple-pin base, recessed base, flanged base, grooved base, side base, or the like.

Figure 1:
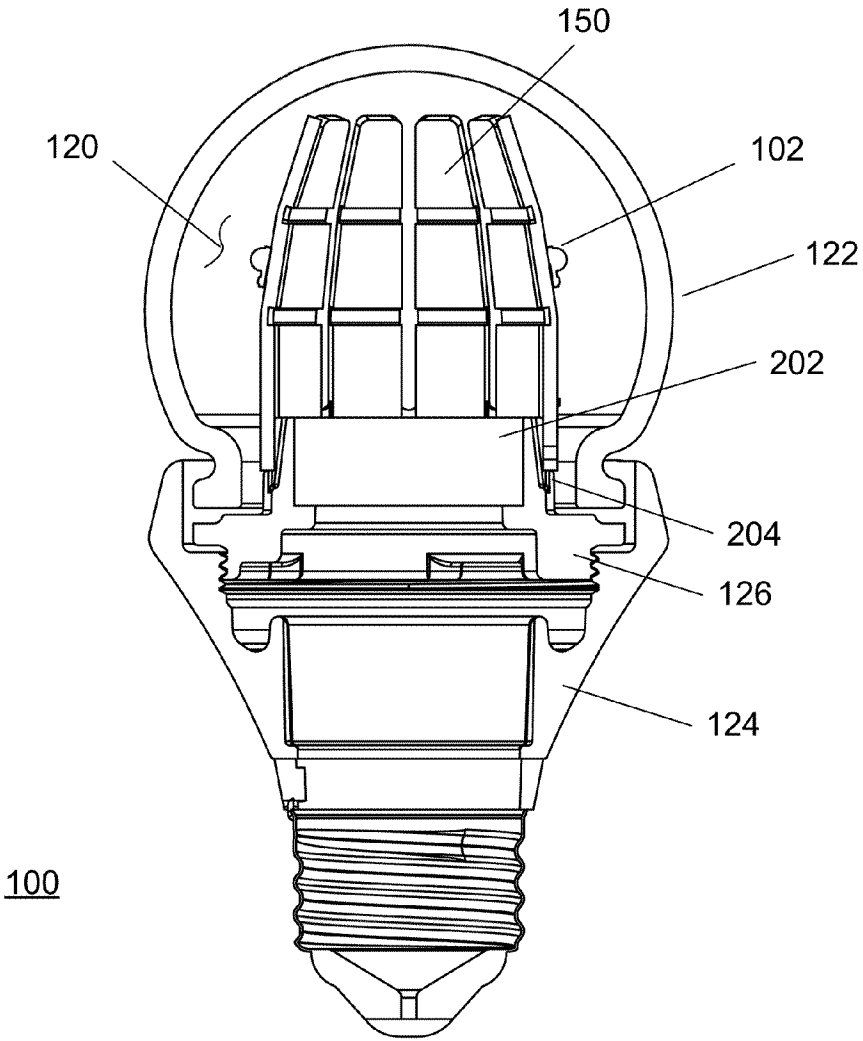
FIG. 1 depicts a cross-sectional view of a liquid-filled LED bulb with a laminate support structure and a hub with a short center protrusion.
Figure 2:
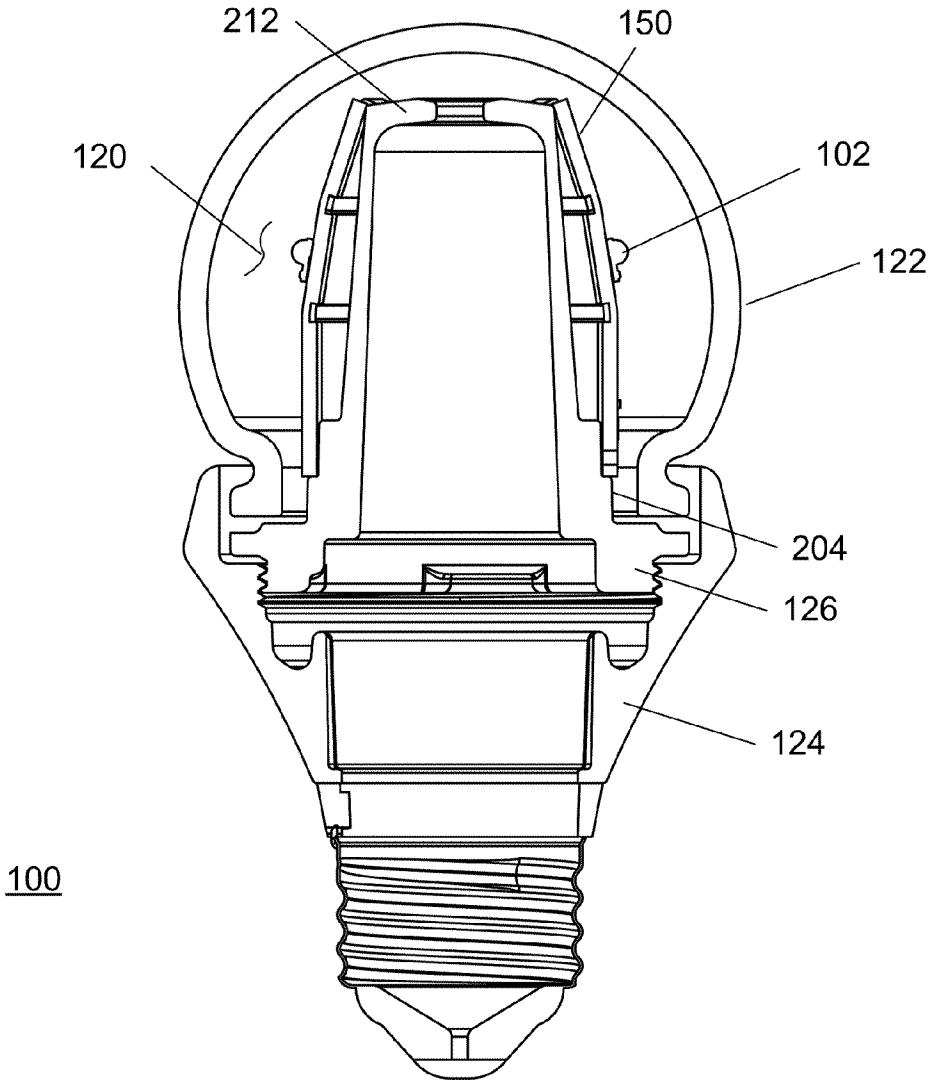
FIG. 2 depicts a cross-sectional view of a liquid-filled LED bulb with a laminate support structure and a hub with a tall center protrusion.

FIGS. 1 and 2 depict a cross-sectional view of an exemplary LED bulb 100. For convenience, all examples provided in the present disclosure describe and show LED bulb 100 being a standard A-type form factor bulb. However, as mentioned above, it should be appreciated that the present disclosure may be applied to LED bulbs having any shape, such as a tubular bulb, a globe-shaped bulb, or the like.

In some embodiments, LED bulb 100 may use 6 W or more of electrical power to produce light equivalent to a 40 W incandescent bulb. In some embodiments, LED bulb 100 may use 20 W or more to produce light equivalent to or greater than a 75 W incandescent bulb. Depending on the efficiency of the LED bulb 100, between 4 W and 16 W of heat energy may be produced when the LED bulb 100 is illuminated.

LED bulb 100 includes a shell 122 and base 124, which interact to form an enclosed volume 120 over one or more LEDs 102. As shown in FIGS. 1 and 2, the base 124 includes an adaptor for connecting the bulb to a lighting fixture. In some cases, the shell 122 and base 124 have a form factor similar to an A-type shape of a conventional incandescent light bulb.

Shell 122 may be made from any transparent or translucent material such as plastic, glass, polycarbonate, or the like. Shell 122 may include dispersion material spread throughout the shell to disperse light generated by LEDs 102. The dispersion material prevents LED bulb 100 from appearing to have one or more point sources of light.

A thermally conductive liquid fills the volume 120. As used herein, the term "liquid" refers to a substance capable of flowing. Also, the substance used as the thermally conductive liquid is a liquid or at the liquid state within, at least, the operating, ambient-temperature range of the bulb. An exemplary temperature range includes temperatures between −40° C. to +40° C. The thermally conductive liquid may be mineral oil, silicone oil, glycols (PAGs), fluorocarbons, or other material capable of flowing. In the examples discussed below, 20 cSt viscosity polydimethylsiloxane (PDMS) liquid sold by Clearco is used as a thermally conductive liquid. It may be desirable to have the liquid chosen be a non-corrosive dielectric. Selecting such a liquid can reduce the likelihood that the liquid will cause electrical shorts and reduce damage done to the components of LED bulb 100.

The thermally conductive liquid is able to transfer heat away from the LEDs 102 and components in thermal connection with the LEDs 102. Typically, the thermally conductive liquid transfers the heat via conduction and convection to other, cooler components of the LED bulb 100, including the shell 122 and base 124. During typical operation, the temperature of the LEDs 102 is higher than that of the shell 122 and base 124. In some cases, the temperature difference between the LEDs 102 and the shell 122 results in passive convective flow of the thermally conductive liquid. The temperature difference between the LEDs 102 and the base 124 may also contribute to the induction of passive convective flow of the thermally conductive liquid. In general, the more heat that can be dissipated into the thermally conductive liquid, the greater the temperature difference between the components resulting in more passive convective flow.

LED bulb 100 also includes a laminate support structure 150 for mounting the plurality of LEDs 102. As shown in FIGS. 1 and 2, the laminate support structure 150 forms a cylindrical or conical shape and the plurality of LEDs 102 are mounted in a radial pattern within the shell 122. The laminate support structure 150 is attached to the base 124 via a hub 126/128.

In the present embodiment, a laser welded bond is used to attach the laminate support structure 150 to the hub 126. The laser weld forms a structural bond between the laminate support structure 150 and the hub 126. In the present embodiment, there is no threaded connection between the laminate support structure 150 and the hub 126. In addition to forming a structural bond between the two pieces, the laser weld also forms a thermal bond between the laminate support structure 150 and the hub 126. Thus, heat generated by the LED can be conducted through the laminate support structure 150 and dissipated to the hub 126 via the laser weld. Heat that is conducted to the hub 126 may also be conducted to base 124 and other components of the LED bulb 100. In an alternative embodiment, the laminate support structure 150 may be laser welded directly to a base to form a structural and thermal bond between the two pieces. In other embodiments, Other types of connections can also be used to attach the laminate support structure to the hub or base, including adhesive bonding, mechanical fastening, clamping, and the like.

FIG. 1 depicts the laminate support structure 150 attached to hub 126 having a center protrusion 202 that is shorter than the laminate support structure 150. The laminate support structure 150 is attached at the lower flange 204 of the hub 126. The LED bulb 100 of FIG. 1 with a center protrusion 202 that is shorter than the laminate support structure 150 allows for more thermally conductive liquid in the center of the enclosed volume 120. This configuration may result in passive convective flow of the thermally conductive liquid in the center of the enclosed volume. The central passive convective flow may assist in thermal dissipation from the inward facing surfaces of the laminate support structure 150.

FIG. 2 depicts the laminate support structure 150 attached to hub 128 having a center protrusion 212 that is approximately the same height as the laminate support structure 150. It is not necessary that the center protrusion 212 be the same height as the laminate support structure 150. The LED bulb 100 of FIG. 2 with center protrusion 212 may allow for multiple attachment points between the laminate support structure 150 and the hub 128. For example, the laminate support structure 150 in FIG. 2 may be attached at a lower flange 210 of the hub 128 and at the upper edge of the center protrusion 212. Having multiple attachment points may assist in thermal conduction between the laminate support structure 150 and the hub 128. In FIG. 2, an amount of thermally conductive liquid is also disposed between the hub 128 and the inward facing surfaces of the laminate support structure 150. Thus, the thermally conductive liquid can also assist in dissipating heat from the inward facing surfaces of the laminate support structure 150.

Figure 3A:
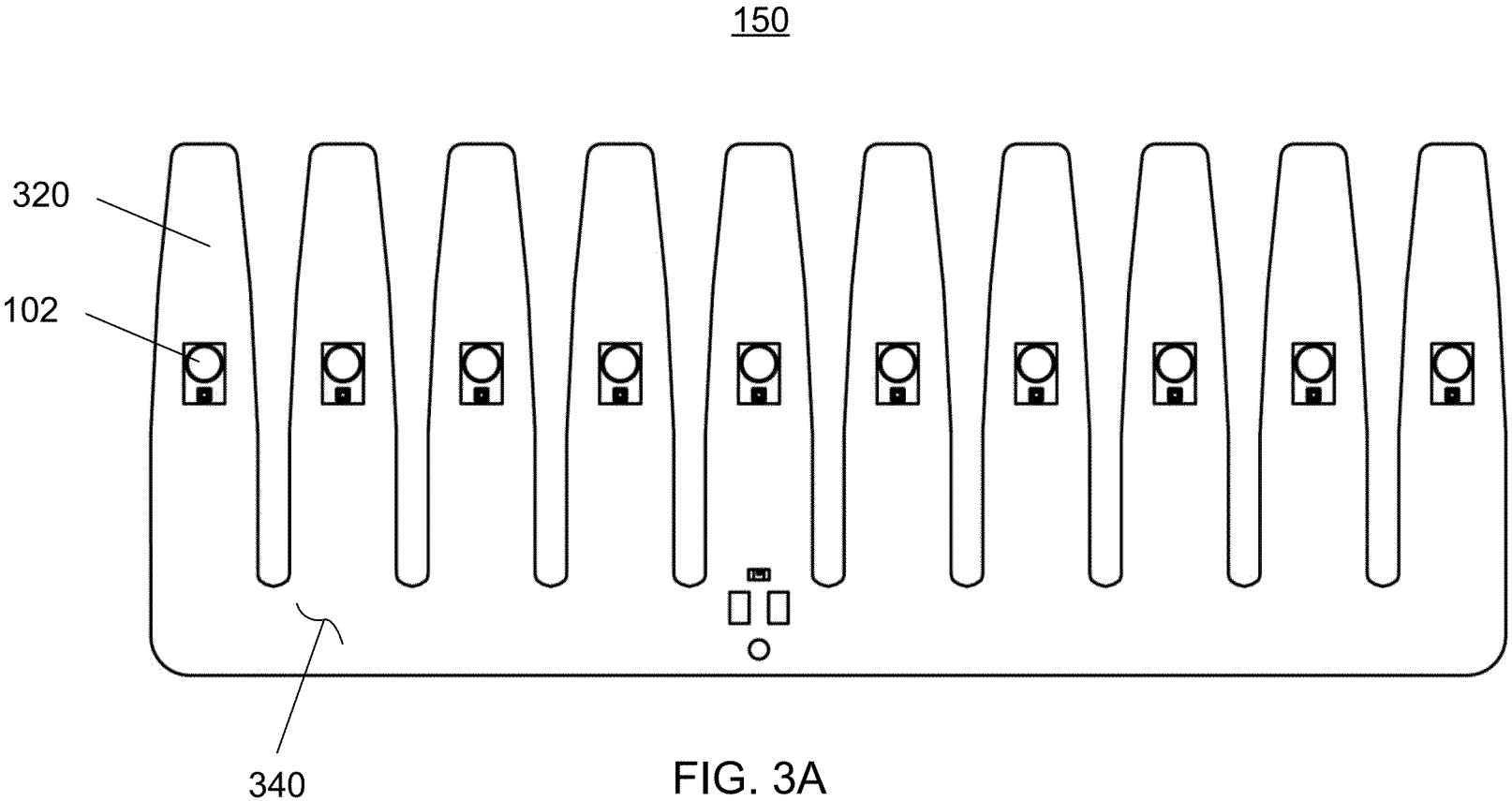
FIG. 3A depicts the top surface of a flat laminate support structure.
Figure 3B:
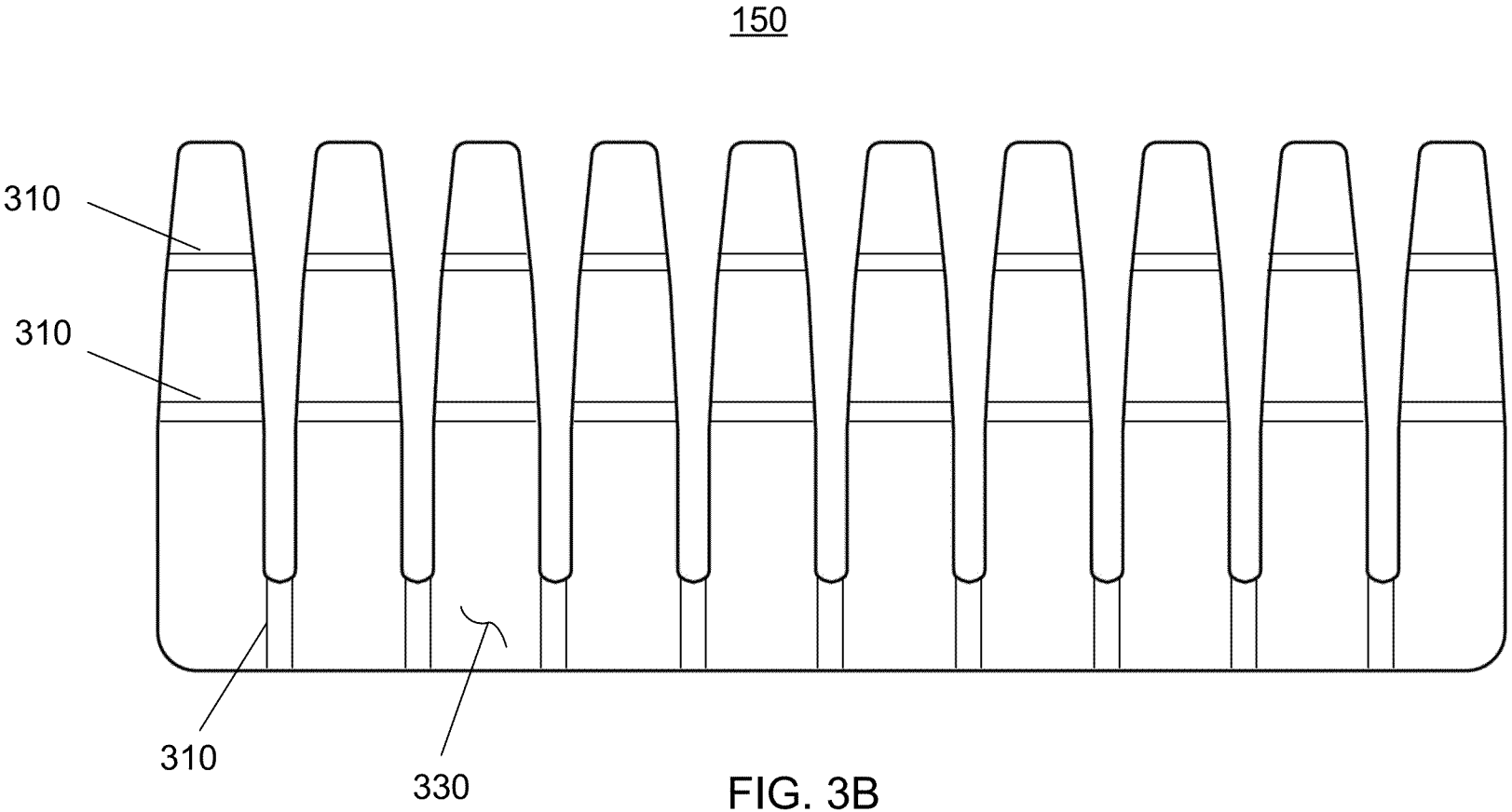
FIG. 3B depicts the bottom surface of a flat laminate support structure.

FIGS. 3A and 3B depict an exemplary laminate support structure 150 having flange portions 320 for mounting LEDs 102. The flange portions 320 are separated by a small gap to allow for passive convective flow of the thermally conductive liquid when the laminate support structure 150 is installed in the LED bulb. The flange portions 320 are wider than the LED 102 to facilitate heat dissipation. The extra width facilitates heat dissipation in at least two ways. First, the extra width of the flange portion 320 provide an increased cross-sectional area of the flange portion for improved thermal conduction from the LED 102 to the base of the laminate support structure 150. The extra width of the flange portion 320 also provides an increased external surface area increasing the contact area between the laminate support structure 150 and the thermally conductive liquid. The increased surface area improves heat transfer into the thermally conductive liquid.

Figure 4B:
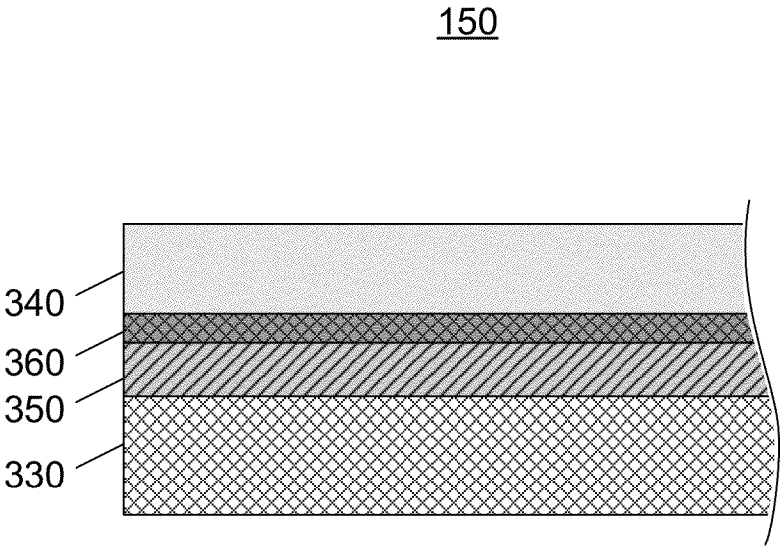
FIGS. 4A and 4B depict cross-sectional views of exemplary laminate support structures.
Figure 4A:
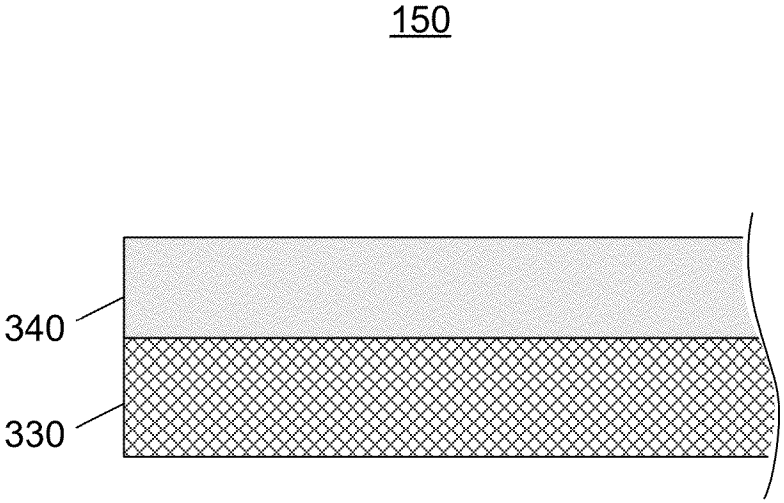

In the present embodiment, the laminate support structure 150 is a laminate. FIGS. 4A and 4B depict cross-sectional view of exemplary laminate support structure 150 that is a laminate. As shown in FIGS. 4A and 4B, the laminate support structure 150 includes, at least two layers, a flexible circuit layer 340 and a mechanical support layer 330. As shown in FIG. 4B, the laminate support structure 150 includes additional layers 350 and 360. The additional layers 350 can be located between the flexible circuit layer 340 and mechanical support layer 330 or on either side of the flexible circuit layer 340 or mechanical support layer 330.

The flexible circuit layer 340 includes mounting pads for mechanically and electrically attaching the LEDs 102. (See, for example, FIG. 3A for LEDs attached to a flexible circuit layer 340.) The flexible circuit layer 340 also includes conductive traces electrically connecting the LEDs 102 to each other. The conductive traces may terminate in one or more terminal connection points that can be used to attach leads from a power supply circuit. The flexible circuit layer 340 also includes one or more dielectric layers to electrically insulate and protect the conductive traces.

The mechanical support layer 330 of the laminate support structure 150 may be formed from a thermally conductive material, such as aluminum, copper, brass, magnesium, zinc, or the like. Since the mechanical support layer 330 is formed using a thermally conductive material, heat generated by LEDs 102 may be conductively transferred to other elements of the LED bulb 100. For example, because the laminate support structure 150 is at least partially immersed in the thermally conductive liquid, the mechanical support layer 330 is able to dissipate heat to the thermally conductive liquid. The mechanical support layer 330 is also connected to the base 124 via the hub 126/128. Depending on the type of connection between the components, the mechanical support layer 330 may conduct heat to the hub 126/128 and base 124.

Figure 5:
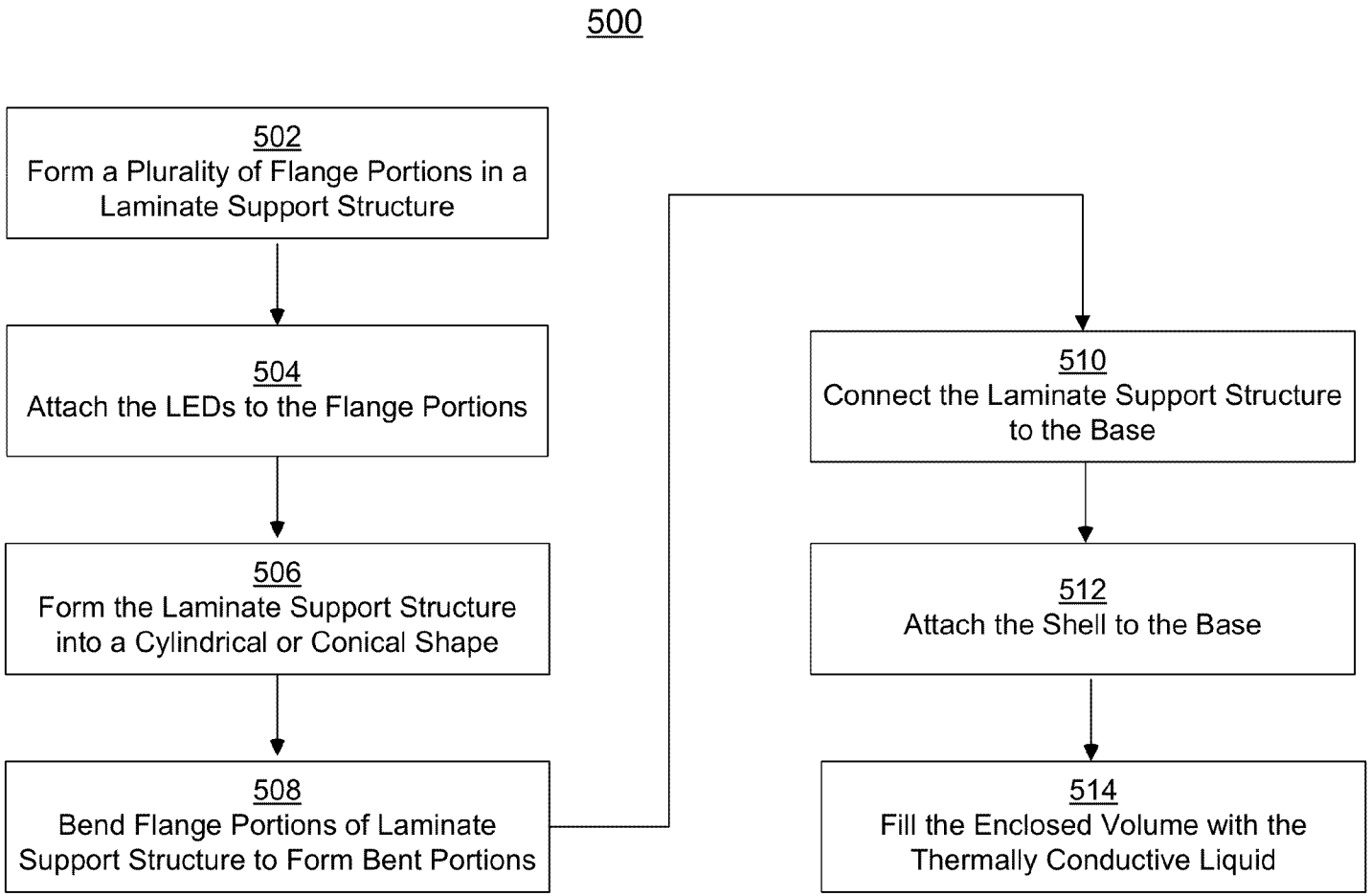
FIG. 5 depicts an exemplary method of making a liquid-filled LED bulb having a laminate support structure.

FIG. 5 depicts a flow chart of an exemplary process 500 for making a liquid-filled LED bulb with a laminate support structure. The operations of process 500 are not necessarily performed in the sequence depicted in FIG. 5.

In operation 502, a plurality of flange portions are formed in a laminate support structure. FIGS. 3 and 4 depict an exemplary flat laminate support structure 150. The flange portions may be formed in the laminate support structure 150 using traditional metal plate machining techniques including laser cutting, milling, stamping, or the like. It may be advantageous to form the flange portions in the laminate support structure 150 when the laminate is flat. It is also possible to form the flange portions when the laminate support structure is formed in a cylindrical or conical shape.

In operation 504, the plurality of LEDs are attached to the flange portion of the laminate support structure. To utilize traditional surface mount or electronic assembly techniques, it may be advantageous to attach the LEDs to the flange portions of the laminate support structure 150 when the laminate is flat. FIG. 3 depicts laminate support structure 150 having a plurality of LEDs attached to the flexible circuit layer 340.

In an optional operation 506, the laminate support structure can be formed into a cylindrical or conical shape. This operation is not required if the laminate support structure is not flat and has already been formed into a cylindrical or conical shape. In some cases, the laminate support structure 150 is formed using a mandrel or round forming tool. FIG. 4 depicts exemplary relief cuts 310 made into the mechanical support layer 330 of the laminate support structure 150. The relief cuts 310 remove part of the material of the mechanical support layer 330 and allow the laminate support structure 150 to be formed into a cylindrical or conical shape while reducing stress and the possibility of cracking or other material failure.

It may be advantageous to form the laminate support structure into a cylindrical or conical shape after the flange portions have been formed and LED components attached. However, it is not necessary that the laminate support structure 150 be attached to the LEDs or completely machined before forming. For example, the base of the laminate support structure may be machined flat or turned true after being formed into a cylindrical shape.

In another optional operation 508, the flange portions of the laminate support structure are bent to form a bent face. This operation is optional because some embodiments do not include a flange portion with a bent face. This operation is also not required if the flange portions have already been bent. Relief cuts 310 (shown in FIG. 3B) allow the flange portions 320 of the laminate support structure 150 to be bent inward toward the center of the laminate support structure 150 forming a bent face. The LEDs 102 can be mounted to the bent face so that the like emitted from the LEDs is angled slightly up. In some embodiments, the angle between the bent face and the central axis of the LED bulb (or laminate support structure 150) is at least 5 degrees. As shown in FIGS. 1 and 2, the laminate support structure 150 may include multiple bends to achieve the desired angle.

In operation 510, the laminate support structure is connected to the base. As shown in FIGS. 1 and 2, the laminate support structure 150 may be connected to the base 124 using hub 126/128. As previously mentioned, in some embodiments, the laminate support structure 150 may be laser welded to the hub 126/128. In the present embodiment, the laser weld forms a structural and thermal bond between the laminate support structure 150 and the hub 126/128. Typically, the laser weld is a continuous or near continuous bead around the perimeter of the laminate support structure. The bead typically has a cross sectional area that is sufficient to conduct the heat flux generated by the LEDs 102 when the bulb is in operation. There are no threaded fasteners or threaded connections between the laminate support structure 150 and the hub 126/128.

In operation 512, the shell is attached to the base to form an enclosed volume. As shown in FIGS. 1 and 2, the shell 122 may be attached to the base 124 forming enclosed volume 120. In operation 514, the LED bulb is at least partially filled with the thermally conductive liquid. On some embodiments, other portions of the LED bulb are at least partially filled with the thermally conductive liquid.

Although a feature may appear to be described in connection with a particular embodiment, one skilled in the art would recognize that various features of the described embodiments may be combined. Moreover, aspects described in connection with an embodiment may stand alone.

What is claimed is:

1. A light-emitting diode (LED) bulb comprising:
- a base;
- a shell connected to the base forming an enclosed volume;
- a thermally conductive liquid held within the enclosed volume;
- a laminate support structure connected to the base,
- a plurality of flange portions formed in the laminate support structure; and
- a plurality of LEDs attached to the plurality of flange portions, the plurality of LEDs arranged in a radial array.

2. The LED bulb of claim 1, wherein the laminate support structure forms a cylindrical or conical shape.

3. The LED bulb of claim 1, wherein the laminate support structure is formed from a circuit layer and mechanical support layer.

4. The LED bulb of claim 3, wherein the mechanical support layer is formed from an aluminum sheet or aluminum foil.

5. The LED bulb of claim 1, wherein a flange portion of the plurality of flange portions includes at least one bent face, wherein the bent face is at an angle from a central axis of the LED bulb, and at least one of the LEDs of the plurality of LEDs is attached to the bent face.

6. The LED bulb of claim 1, wherein the angle is at least 5 degrees.

7. The LED bulb of claim 1, wherein the laminate support structure is coupled to a hub and the hub is coupled to the base.

8. The LED bulb of claim 7, wherein the laminate support structure is coupled to the hub with a laser weld joint to form a structural and thermal bond between the laminate support structure and the hub.

9. A method of making a light-emitting diode (LED) bulb, the method comprising:
- forming a plurality of flange portions in a laminate support structure;
- attaching a plurality of LEDs to the plurality of flange portions of the laminate support structure;
- connecting the laminate support structure to a base;
- attaching a shell to the base; and
- filling at least a portion of the LED bulb with a thermally conductive liquid.

10. The method of making an LED bulb of claim 9, further comprising forming the laminate support structure into a cylindrical or conical shape.

11. The method of making an LED bulb of claim 10, further comprising forming a plurality of relief cuts in the laminate support structure prior to forming the laminate support structure into a cylindrical or conical shape.

12. The method of making an LED bulb of claim 10, further comprising bending an end of a flange portion of the plurality of flange portions to form a bent face, wherein the bent face is at an angle with respect to the central axis of the LED bulb, and at least one of the LEDs of the plurality of LEDs is attached to the bent face.

13. The method of making an LED bulb of claim 12, wherein the angle is at least 5 degrees.

14. The method of making an LED bulb of claim 9, wherein the laminate support structure is formed from a circuit layer and mechanical support layer, the circuit layer comprising one or more electrical traces, wherein at least one of the LEDs of the plurality of LEDs is electrically connected to the one or more electrical traces.

15. The method of making an LED bulb of claim 9, wherein connecting the laminate support structure to a base comprises:

laser welding the laminate support structure to a hub to form a structural and thermal bond between the laminate support structure and the hub, and coupling the hub to the base.

16. The method of making an LED bulb of claim 9, wherein filling at least the portion of the LED bulb with the thermally conductive liquid occurs prior to attaching the shell to the base.

* * * * *